US005823088A

United States Patent [19]

Frisch

[11] Patent Number: 5,823,088

[45] Date of Patent: Oct. 20, 1998

[54] PNEUMATIC ACTUATING ARRANGEMENT

[75] Inventor: Herbert Frisch, Vienna, Austria

[73] Assignee: Hygrama AG, Rotkreuz, Switzerland

[21] Appl. No.: 848,015

[22] Filed: Apr. 28, 1997

[51] Int. Cl.[6] ..... F01B 25/26; F15B 13/16

[52] U.S. Cl. ..... 91/1; 91/361; 91/459; 60/407

[58] Field of Search ..... 91/508, 361–459; 60/420, 407

[56] References Cited

U.S. PATENT DOCUMENTS

| | | | |
|---|---|---|---|
| 4,292,804 | 10/1981 | Rogers, Sr. | 60/407 |
| 4,507,918 | 4/1985 | Holleyman | 60/407 X |
| 5,035,113 | 7/1991 | Simonyi et al. | 91/361 X |
| 5,065,663 | 11/1991 | Stadler et al. | 91/459 X |
| 5,458,047 | 10/1995 | McCormick | 91/361 |

*Primary Examiner*—Hoang Nguyen
*Attorney, Agent, or Firm*—Watson Cole Grindle Watson, P.L.L.C.

[57] ABSTRACT

A pneumatic actuating arrangement with a plurality of consumers (1) having working areas (7,8), a plurality of feed air/signal distributors (13) connected to a common pressure source and a common control unit (19), a plurality of electrically-actuated switching devices respectively arranged directly at the consumers (1) forming separate consumer units (9), and a combination line (12) extending between each consumer unit (9) and a feed air/signal distributor (13), each combination line including a supply pressure line for supplying air to the working areas of a respective consumer and electrical signal lines for connecting the electrically-actuated switching devices of a respective consumer unit to said common control unit.

8 Claims, 4 Drawing Sheets

Fig. 1
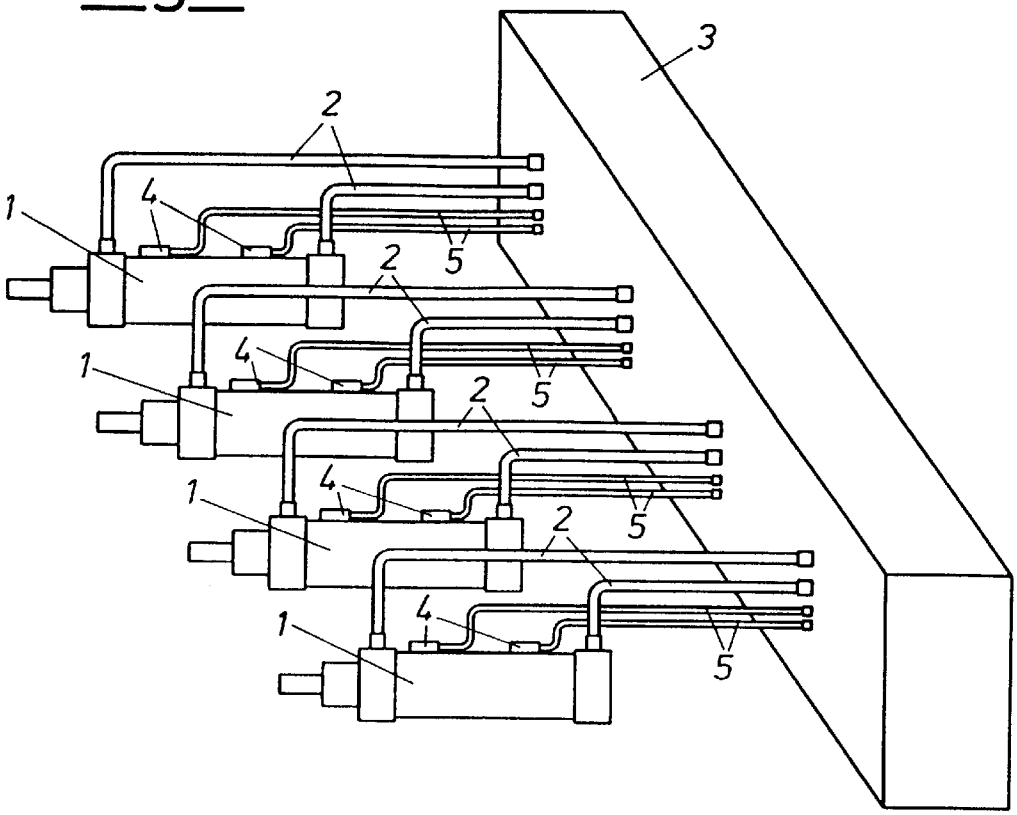
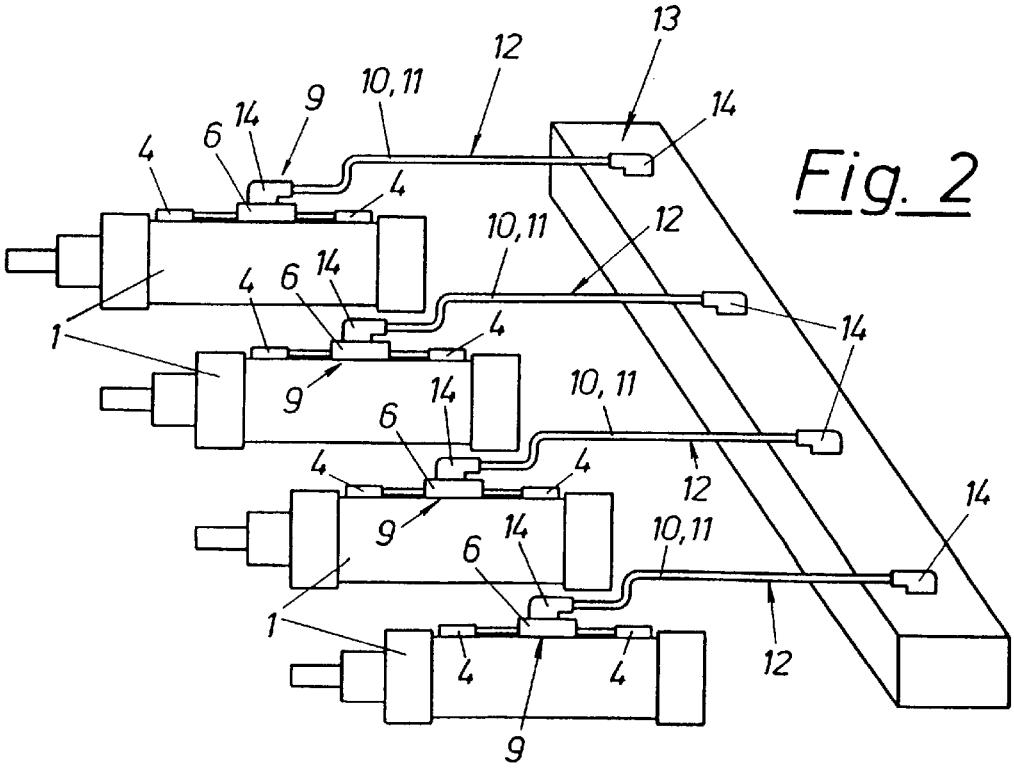
Fig. 2

PNEUMATIC ACTUATING ARRANGEMENT

BACKGROUND OF THE INVENTION

1. Field of the Invention

This invention relates to a pneumatic actuating arrangement with a number of pneumatic consumers, in particular working cylinders, whose working areas are connected via pressure lines with electrically-actuated switching devices, the switching devices being in turn connected via supply pressure lines with a common pressure source and via electrical signal lines with a common control unit.

2. The Prior Art

Arrangements of the aforementioned kind are widely used today in production plants, transport and storage facilities and the like, because with small dimensions and relatively simple installation, they provide reliably great forces and also wide setting ranges when necessary, and as a result of the flexibility of the working medium, they also have a number of advantages over hydraulic or electric drives. When directly compared with a hydraulically-actuated cylinder/piston arrangement as regards the required connecting lines for the work medium, the pneumatically-actuated arrangement directly offers the advantage that the volume reduction from the respectively depressurized working area typically can occur simply into the open air and does not have to be fed back to a pump or the like. However, such a pneumatic working cylinder in typical actuation arrangements of the aforementioned kind requires a number of connections that involve relatively great expense with respect to construction, accommodation, maintenance, etc., and also represent potential sources of malfunction.

Together with the required switching devices which are nowadays practically exclusively electrically actuated, or at least electrically pilot-operated, a pneumatic working cylinder, for example, utilizes two pressure lines for connecting its two working areas with the related switching device, a supply pressure line for connecting the switching device with the pressure source, and at least one electrical signal line for driving the switching device from a control unit. If, as is often the case, at least the two end positions of the working cylinder must be monitored by or reported to the control unit, electrical signal lines are additionally required between the corresponding sensors and the control unit. All of these lines must be laid and connected at both ends with the corresponding connections, requiring a quantity of additional components and installation costs.

Starting with the recognition of this difficulty, or its negative effect on the use of such actuation arrangements, corresponding arrangements have recently become known in which the switching devices of several pneumatic consumers, adjacent to each other in the overall arrangement, are combined into so-called valve islands. In doing so, the required switching devices are mounted on a shared base plate with a shared air feed and a combined electrical drive. The electrical drive may be assembled via a multipole connector or a bus system, whereby the use of bus systems yields altogether the least installation expenditure, according to the present state of the art, for actuation arrangements of the kind previously mentioned. The disadvantage in this connection is still a relatively high assembly cost in spite of everything, because per pneumatic consumer, such as pneumatic working cylinders in particular, two pressurized air hoses (between each of the working areas and the valve island) and, when necessary, also two electrical signal lines (between the position sensors and the valve island) must still be laid and in each case directly connected at both ends or provided with connectors.

The object of the present invention is to provide a pneumatic actuation arrangement of the kind mentioned which, while avoiding the noted disadvantages of the known arrangements, is characterized by reduced installation and maintenance costs.

SUMMARY OF THE INVENTION

This object is achieved in a pneumatic actuation arrangement of the noted kind by having the switching devices together with the pressure lines to the working areas, which form a consumer unit, in each case arranged directly at the consumers, and by having the electrical signal lines and the supply pressure lines of each consumer unit combined in a combination line which extends between the consumer unit on the one hand and, on the other hand, a feed air/signal distributor connected with the pressure source and the control unit. In this way, each individual consumer, i.e., each working cylinder for example, is only connected (or to be connected) via a single combination line with the rest of the system, offering considerable advantages with respect to the laying of this line or the production of the connections and the like.

In this connection, the arrangement of reversing valves along with the related pressure lines to the working areas directly at pneumatic working cylinders is basically already known—what is novel and advantageous in the present context is the formation of the aforementioned consumer unit, which is connected via a single combination line with the related feed air/signal distributor.

Particularly preferred is another design of the invention, wherein the combination lines have combination connectors at both ends for the joint connection with the associated pressure connections and electrical connections. In this way, the assembly and dismantling of the individual consumers or distributors in such a pneumatic actuation arrangement is substantially simplified because, for example, before removing a defective working cylinder or the like, only a single combination connector needs to be detached or removed.

According to another preferred development of the invention, the feed air/signal distributor of several consumer units are combined to form a block-like assembly provided with shared supply line and signal line connections. In this way, from the pressure source on the one hand and/or the control unit on the other hand, in each case only a single line connection goes to such a feed air/signal distributor block, from which in turn in each case only a single combination line runs from each of the distributors to the related consumer. The result is an extremely simple overall arrangement with greatly reduced assembly and maintenance costs, whereby sources of errors due to individual mistaken connector-connections or the like are also largely eliminated.

The connection of the feed air/signal distributor blocks with each other or with the pressure source and the control unit can be made in a further design of the invention also via combination lines and combination connectors, offering further simplification possibilities for the overall arrangement.

In a pneumatic actuation arrangement in which, as already discussed above, function sensors are arranged at the consumer units, in particular piston position sensors are arranged at the working cylinders and are connected via electrical signal lines with the control unit, in a further preferred design of the invention the signal lines of these sensors are also run in the combination lines and, when necessary, via the combination connectors. The connection of the consumer units designed as described still takes place via a single combination line in such a way that the above-described advantages of the invention are fully utilized in this instance as well.

According to another preferred design of the invention, bus nodal points for the signal lines are arranged at the consumer units, whereby the signal lines situated in between and the signal lines leading to the control unit may be designed as bus connections, preferably according to the known ASI standard. This measure also improves or simplifies assembly and maintenance of the actuation arrangement according to the invention.

The invention will be explained in greater detail with the aid of the partially schematically illustrated embodiment depicted in the drawings.

BRIEF DESCRIPTION OF THE DRAWINGS

FIG. 1 shows an example of a pneumatic actuation arrangement with valve islands according to the state of the art;

FIG. 2 shows in corresponding schematic illustration an embodiment of an arrangement according to the present invention;

DETAILED DESCRIPTION OF THE PREFERRED EMBODIMENT

Figure 3:
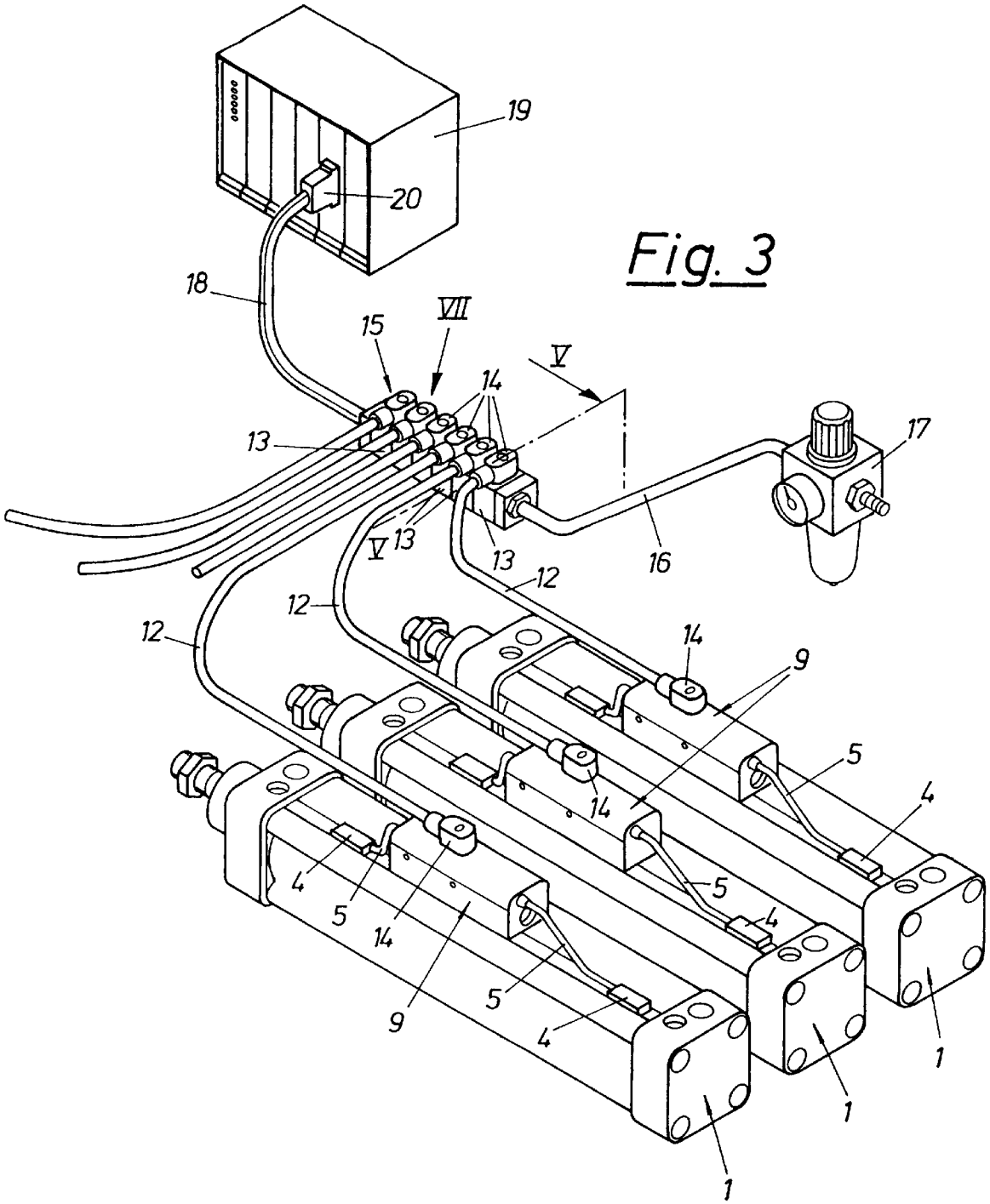
FIG. 3 is a detailed perspective view of a further embodiment according to the present invention.

A pneumatic actuation arrangement according to the state of the art is shown in FIG. 1. It is shown to include four separate pneumatic consumers that are designed in this case as working cylinders for tasks of no further interest, for example in a production plant or the like. The working areas situated at both ends of the piston (not shown) are each connected via separate pressure lines 2 with electrically-actuated switching devices (also not shown here) which are combined in one so-called valve island 3 (shown schematically). In addition, arranged on the consumers 1 are function sensors 4 which in this case inductively monitor the piston end positions, for example, and are also connected with the valve island 3 via electrical signal lines 5.

The valve islands 3 are usually arranged in the vicinity of a related group of consumers 1 or the switching devices combined there for the consumers 1 to be connected, in a manner also not shown here, via electrical signal lines with a shared control unit to which the signals of the function sensors 4 are fed. The electrical drive can be combined either via a multipole connector or a bus system, thus resulting in the lowest installation costs for such pneumatic actuation arrangements according to the present state of the art.

The disadvantage is still a relatively high assembly cost in spite of everything, because per pneumatic consumer 1, two pressure lines (between each of the working areas and the valve island 3) and also two electrical signal lines 5 (between the function sensors 4 and the valve island 3) must still be laid and in each case either directly connected at both ends or provided with connectors.

In an arrangement corresponding in function to the known arrangement according to FIG. 1, the present invention, as shown in FIG. 2, includes switching devices 6 along with the pressure lines to the working areas (see positions 2 and 7, 8 in FIG. 4), forming a consumer unit 9, are in each case arranged directly at the consumers 1. In addition, the electrical signal lines 10 (see also section illustration according to FIG. 4) and the supply pressure line 11 of each consumer unit 9 are combined in a combination line 12, which then acts as the sole connection between the consumer unit 9 on the one hand and, on the other hand, a feed air/signal distributor 13 connected in a manner not shown here with the shared pressure source and the shared control unit.

The combination lines 12 have—as can be seen in particular also in FIGS. 3 through 7—combination connectors 14 at both ends for common connection with the related pressure connections and electrical connections, but if necessary could also provide for these connections via separate connector-connections or the like. The signal lines 5 of the function sensors 4 are also run in these combination lines 12.

As can be seen in FIG. 2, on the one hand, and FIGS. 3 through 7 on the other hand, it is insignificant whether a feed air/signal distributor 13 has several separate connections for several consumers 1 or whether (FIGS. 3 or 7) in each case individual feed air/signal distributors 13 are provided for each consumer 1, which can then, for example, also be combined block-like into feed air/signal distributor blocks 15 and provided with shared supply pressure line and signal line connections. It is essential that each individual consumer 1 or each consumer unit 9 is henceforth connected, or to be connected during the assembly, only via a single combination line 12 with the rest of the system, offering considerable advantages with respect to the laying of the lines, the production of the connections and the like.

According to FIG. 3, three separate pneumatic consumers 1 or consumer units 9 designed once again as working cylinders are each connected again via a single combination line 12 with a feed air/signal distributor 13. At both ends of the combination line 12, once again combination connectors 14 are mounted that allow a joint connection of supply pressure lines and signal lines. The individual feed air/signal distributors 13 are combined into a feed air/signal distributor block 15. The consumers supplied by the upper three individual feed air/signal distributors 13 in the illustration are not shown.

The feed air/signal distributor block 15 according to FIG. 3 is connected on one side via a pressure line 16 and an air filter 17 (oiler, pressure regulator or the like) with the shared pressure source (not shown). On the other hand, this feed air/signal distributor block 15 is connected via a bus connection 18 with an electrical or electronic control unit 19 or is connected to it via a connector 20.

In addition, it can also be seen from FIG. 3 that the function sensors 4, designed again as piston end position sensors, are also connected via the signal lines 5 with the consumer units 9. The corresponding signals are fed from there via the combination connectors 14 and the combination lines 12 to the feed air/signal distributors 13 and from there via the bus connection 18 to the control unit 19.

Figure 4:
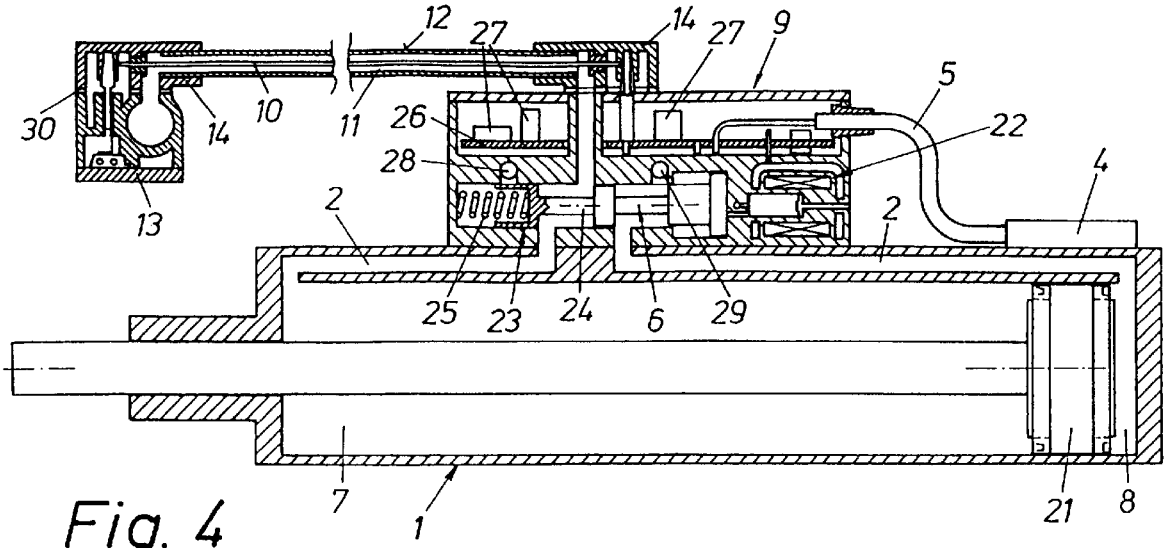
FIG. 4 is a schematic section of the connection of a feed air/signal distributor with a consumer unit of a further actuation embodiment designed according to the invention.

FIG. 4 shows in section and in somewhat more detail an individual consumer unit 9 fully corresponding in function to the arrangements according to FIGS. 2 and 3, connected to the related feed air/signal distributor 13. The working areas 7, 8 of the consumer 1, situated at both ends of the piston 21, are connected with the switching device 6 via pressure lines 2 arranged directly at the consumer 1; the switching device is designed in this instance as a piston slide valve 23 driven via an electromagnetic pilot valve 22. At the end of the slider 24 opposite the pilot valve 22, a spring 25 is arranged that ensures the pressure impact on the working area 7 when the magnet is without current, while in the case of an electrically-actuated pilot valve 22, the slider 24 moves pneumatically against the force of the spring 25 into the other end position and the working area 8 is connected with the supply pressure line 11. Air evacuation connections 28 and 29 for the two working areas 7, 8, enable the respective working area to have air evacuated therefrom directly into the open air, based on the corresponding position of the slider 24.

In a housing of the consumer unit 9 above the switching device 6, a board 26 with electrical or electronic components 27 is suggested. This is connected on the one hand via the combination connector 14 with the signal line or lines 10 in the combination line 12 and, on the other hand, with the signal line 5 to the function sensor 4 (shown only individually here) or, in a manner not shown in greater detail, with the electromagnetic pilot valve 22. If the electrical signal lines 10 are designed as bus connections, the respective bus nodal point is also produced by this board 26 or the components 27 suggested on top of it, in that the bus signals are received and emitted or coded and decoded.

Arranged at the end of the combination line 12 opposite the consumer unit 9 is also a combination connector 14 that is placed on the related feed air/signal distributor 13 and sealed by means of a seal 30. For a more detailed description of the related details, refer to the embodiments in FIGS. 5 through 7, which show in detail a combination of feed air/signal distributor 13 and combination connector 14 designed identically at least in function.

Figure 5:
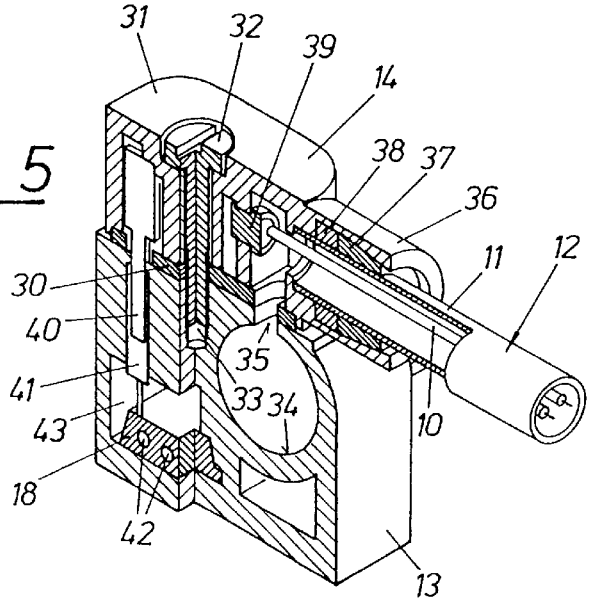
FIG. 5 is a partial section along the line 5—5 of the embodiment according to FIG. 3.
Figure 6:
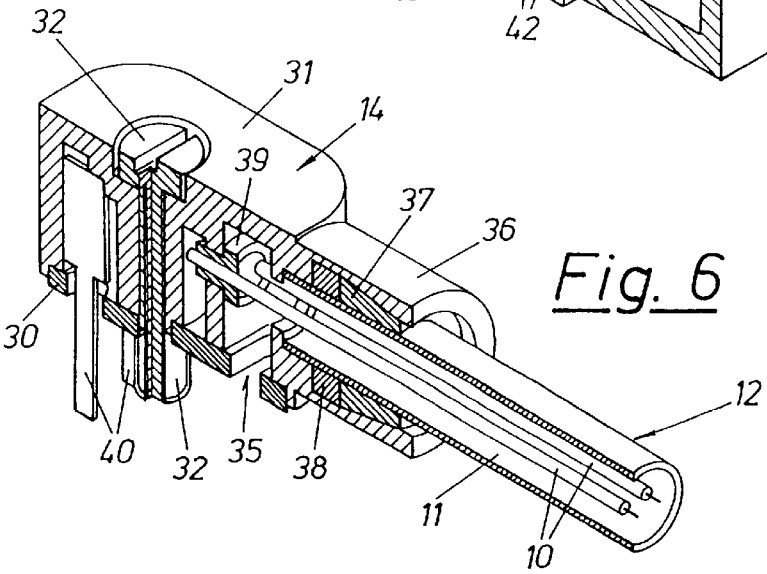
FIG. 6 is an enlarged section of FIG. 5, wherein only the removed combination connector is shown.
Figure 7:
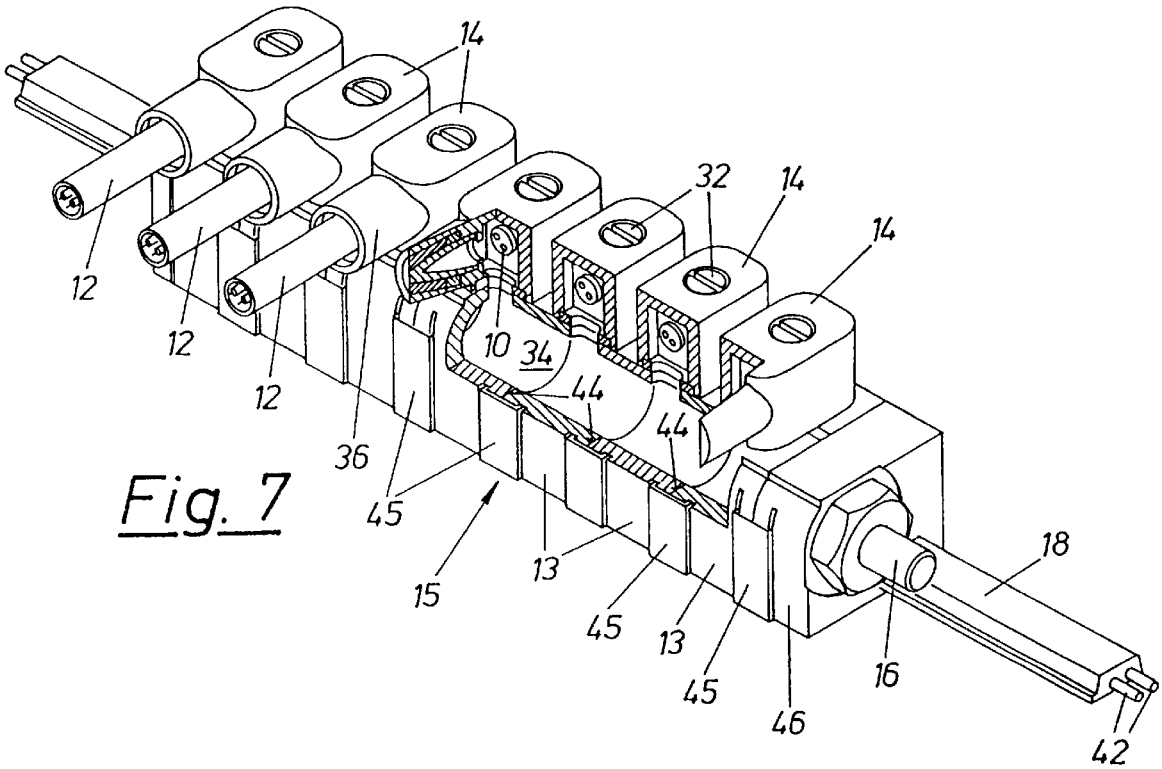
FIG. 7 shows a detailed view similar to A in FIG. 3, in partial section.

The combination connector 14 according to FIGS. 5 through 7 has a housing 31 of diecast light metal or a suitable plastic or the like which can be attached via a central screw 32 to a threaded bore 33 of the feed air/signal distributor 13, thus producing the required connections for the pressurized air on the one hand and, on the other hand, for the signal lines or bus connections. The pressurized air supplied in the distributor 13 in a bore 34 (see pressure line 16 in FIG. 3) makes its way via an opening 35 into the housing 31 of the combination connector and from there into the inside of the combination line 12. The sheath of the supply pressure line 11 of the combination line 12 is inserted in a stud 36 on the housing 31, held by a longitudinally slotted holding cone 37 and sealed with a seal 38. In addition, the above-mentioned seal 30 is inserted between the combination connector 14 and the distributor 13; it is pressed together when the screw 32 is screwed in.

The signal line 10 running inside the combination line 12 or supply pressure line 11 is sealed separately by means of a seal 39 at the exit from the pressurized air area and, in a manner not shown in greater detail, is connected with two separate plug-connections 40 that engage female connectors 41 of the distributor 13. These female connectors 41 are contacted, also in a manner not shown in greater detail, with the conductors 42 of the bus connection 18 which can be designed according to the known ASI standard, for example. The cable of the bus connection 18 runs in a corresponding recess 43 (as can be seen from FIG. 7 in particular) through all individual distributors 13 combined into a feed air/signal distributor block 15, whereby the connection to the female connectors 41 can be made by simple cutting of the respective cable end during assembly, for example.

FIG. 7 additionally shows that the individual feed air/signal distributors 13 are sealed from each other by means of seals 44 and are clamped together by means of retaining clamps 45 pushed on from below. At the overall front end of the block, as shown in the illustration, an end piece 46 is arranged for connection with the pressure line 16 or for closed introduction of the bus connection 1. A corresponding end piece without pressure line connection may also be provided at the rear end in the illustration.

The connection of the individual feed air/signal distributors 13 together could take place via screw connections or the like—as suggested in FIG. 2 a continuous housing for several individual distributors would also be possible. The combination connectors 14 could also be connected securely and tightly with the distributors by means of other suitable elements instead of the screws 32. The design of the combination connectors and the distributors could have also be modified in construction for different applications. Departing from the illustrated design, the pressure and signal connection of several feed air/signal distributor blocks 15 together or with a shared control and pressure supply unit could also take place via corresponding combination lines and combination connectors.

I claim:

1. Pneumatic actuating arrangement comprising a plurality of pneumatic consumer devices (1) which define working areas (7,8), a plurality of electrically-actuated switching devices (6) which are respectively located at said consumer devices to form separate consumer units (9), a plurality of feed air/signal distributors (13) connected to a pressure source and to a control unit (19), and a combination line (12) comprising electrical signal lines and a supply pressure line extending between each consumer unit (9) and one of said plurality of feed air/signal distributors (13).

2. Pneumatic actuating arrangement according to claim 1, including combination connectors (14) at opposite ends of each said combination line (12) for joint connection with respective pressure connections and electrical connections.

3. Pneumatic actuating arrangement according to claim 1, wherein a plurality of said feed air/signal distributors (13) are connected together to form a block, said block including shared supply line and electrical signal line connections.

4. Pneumatic actuating arrangement according to claim 3, wherein the connection of the feed air/signal distributor blocks (15) with each other or with the pressure source and the control unit (19) can be made via combination lines (12) and combination connectors (14).

5. Pneumatic actuating arrangement according to claim 1, including function sensors (4) arranged at the consumer units (9) and wherein some of said electrical signal lines connect said function sensors with the control unit (19).

6. Pneumatic actuating arrangement according to claim 5, wherein said function sensors comprise piston position sensors.

7. Pneumatic actuating arrangement according to claim 1, wherein bus nodal points for the signal lines (10,5) are arranged at the consumer units (9) and the signal lines situated in between and the signal lines leading to the control unit (19) are designed as bus connections.

8. Pneumatic actuating arrangement according to claim 1, wherein said pneumatic consumer devices comprise working cylinders.

* * * * *